US005590476A

United States Patent [19]

Alakoski et al.

[11] Patent Number: 5,590,476

[45] Date of Patent: Jan. 7, 1997

[54] MULTI-STORY DRYER SECTION IN A PAPER MACHINE

[75] Inventors: Markku Alakoski; Antti Ilmarinen, both of Jyväskylä ; Martti Tissari, Jyskä ; Kyösti Uuttana, Jyväskylä, all of Finland

[73] Assignee: Valmet Corporation, Helsinki, Finland

[21] Appl. No.: 494,944

[22] Filed: Jun. 26, 1995

[30] Foreign Application Priority Data

Jun. 28, 1994 [FI] Finland ..... 943096

[51] Int. Cl.[6] ..... F26B 11/02

[52] U.S. Cl. ..... 34/117; 34/114; 34/116

[58] Field of Search ..... 34/114, 116, 117

[56] References Cited

U.S. PATENT DOCUMENTS 3,868,780 3/1975 Soininen et al. ..... 34/116
4,972,608 11/1990 Ilvespaa ..... 34/115
5,022,163 6/1991 Ilvespaa et al. ..... 34/23
5,064,503 11/1991 Tavi ..... 162/359

FOREIGN PATENT DOCUMENTS 53333 5/1974 Finland .
82097 8/1990 Finland .

*Primary Examiner*—Henry A. Bennett
*Assistant Examiner*—Dinnatia Doster
*Attorney, Agent, or Firm*—Steinberg, Raskin & Davidson, P.C.

[57] ABSTRACT

A dryer section in a paper machine which comprises a number of dryer groups, each having drying cylinders, reversing cylinders arranged between adjacent pairs of drying cylinders and a wire which presses the web against heated cylinder faces of the drying cylinders whereas the web remains at the side of the outside curve on the reversing cylinders. The dryer groups are arranged in two or more stories. Some of the dryer groups in the dryer section are placed in the basement spaces underneath the machine hall level, and some of them are placed on the machine hall level.

22 Claims, 9 Drawing Sheets

MULTI-STORY DRYER SECTION IN A PAPER MACHINE

FIELD OF THE INVENTION

The present invention relates to a dryer section in a paper machine which comprises a plurality of dryer groups, each of which includes drying cylinders, reversing cylinders and a wire which presses the web on the drying cylinders against the heated cylinder faces thereof while the web remains at the side of the outside curve on the reversing cylinders placed between the drying cylinders, i.e., the wire is situated between the web and the outer surfaces of the reversing cylinder.

BACKGROUND OF THE INVENTION

As known from the prior art, on the floor of the basement space situated underneath the dryer section of a paper machine, a broke conveyor is placed and functions to receive the paper web that falls down from the dryer section, in the event of a web break, and carry the same into a pulper. Thus, the provisions for the paper that falls down from the dryer section onto the broke conveyor occupy the entire basement space so that no other equipment can be placed there. The inability to place other equipment in the basement spaces is also restricted by the fact that the basement spaces are moist and hot spaces. As known from the prior art, the basement space is a substantially integral space with the interior of the hood placed on the dryer section above the floor level of the paper machine hall. As such, in the basement space, substantially the same moist and hot atmosphere is present as in the interior of the hood. As is also known from the prior art, the basement space is provided with a so-called basement hood by whose means, together with the hood placed above the floor level, the moist and hot spaces of the dryer section are isolated from the paper machine hall and from the rest of the environment. In a manner in itself known to those skilled in the art, the hood spaces are provided with means for air conditioning and recovery of heat.

The prior art basement space placed underneath the dryer section is, with the exception of the removal of the paper broke, primarily unused lost space, which must, moreover, be provided with the basement hood. Typically, the dimensions of the basement space are about 5 m×10 m×80 m or about 4000 cubic meters.

In a manner known in the prior art, when groups with twin-wire draw are used in the dryer section, a part of the top portion of the basement space is used for the runs of the loops of the lower drying wires and for the guide rolls. In recent years though, increasing use has been made of single-wire draw and, in connection with it, of so-called normal groups, in which the drying cylinders are placed in the upper row and the reversing suction rolls or cylinders in the lower row, in which case the loops of the drying wires run above the dryer groups. In such a case, an increased proportion of useless, lost space remains in the basement space.

Conventionally, to construct a dryer section, one manufacturer supplies the dryer section of the paper machine, and some other supplier constructs the basement space placed underneath, in which case the overall solution does not always become optimal in every respect.

OBJECTS AND SUMMARY OF THE INVENTION

An object of the present invention is to provide a novel solution of space for the basement space situated below the dryer section of a paper machine, in which solution the basement space can be utilized more efficiently than in prior art constructions.

It is a further object of the invention to provide such a solution of the basement space for the dryer section in the paper machine hall in which it is possible to reduce the rest of the requirement of space of the paper machine hall and to make the arrangements of space in the paper mill more versatile.

In view of achieving the objects stated above and others, the dryer section in accordance with the invention basically comprises dryer groups arranged in two or more stories, e.g., the level of the machine hall being one story and the basement space being another story.

According to the invention, the dryer section has been arranged in dryer groups placed in two or more stories, in which case the overall length of the dryer section can be made considerably shorter. At the same time, a substantial portion of or the entire basement space, which was useless in the prior art constructions, can be brought to a beneficial use.

The arrangement in accordance with the invention provides an entirely novel lay-out construction for a paper mill, in which the transport operations and the transfers can be formed in compliance with an entirely novel mode of thinking.

According to the invention, both or all of the stories are air-conditioned separately, and the intermediate floor/floors is/are, of course, arranged as load-bearing.

In a dryer section in accordance with the invention, preferably, normal groups with single-wire draw in themselves known are used, in which the heated drying cylinders are arranged in the upper row and the reversing cylinders are arranged in the lower row below the upper row of drying cylinders, and in which single-wire draw, in each cylinder group, there is one drying wire only on whose support the web runs through the whole group. In this manner, the drying wire presses the web on the drying cylinders against the heated cylinder faces, and on the reversing cylinders arranged between the drying cylinders the web remains at the side of the outside curve. Thus, in single-wire draw, the drying cylinders are arranged outside the wire loop and the reversing cylinders are arranged inside the wire loop.

According to the invention, a considerable reduction in the length of the paper machine is achieved, by means of which considerable economies are obtained in the cost of production of the paper machine hall, the economies being up to about 40%.

The runnability of the dryer section of a paper machine in accordance with the invention is very good, because it does not require separate arrangement of inverted groups with single-wire draw, as the face of the web that is placed against the drying cylinders can be changed readily when the story is changed.

In the following, the invention will be described in more detail with reference to the figures in the accompanying drawing. However, the invention is not strictly confined to the details of the illustrated embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE DRAWINGS

Figure 1A:
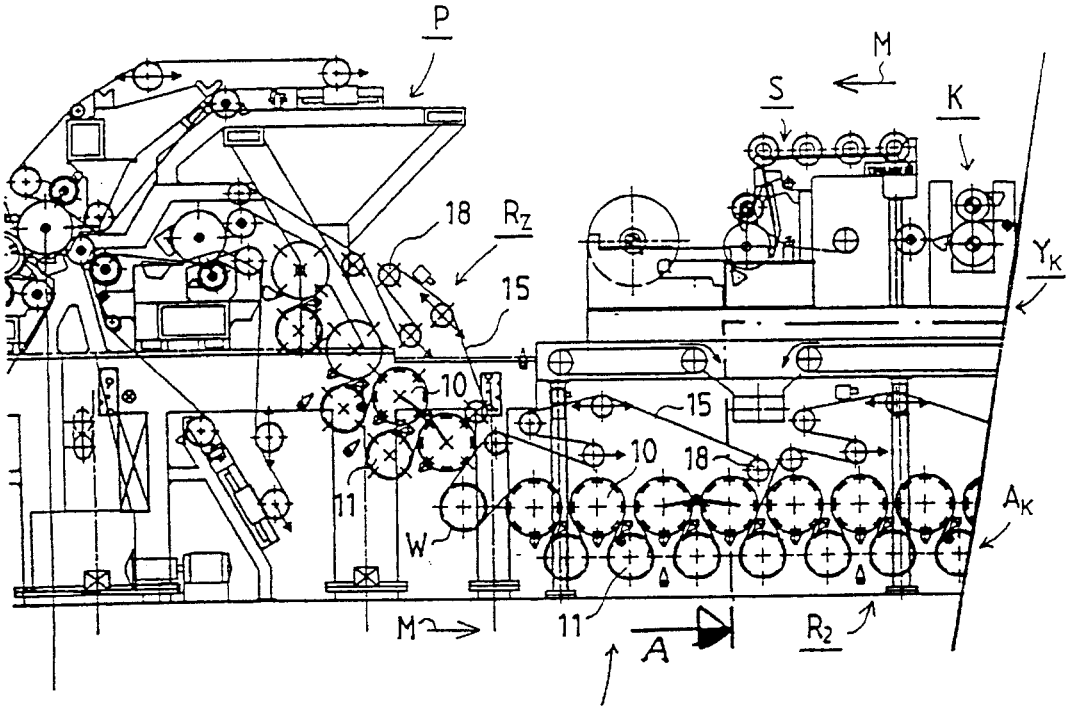
FIGS. 1A and 1B are each partial side views of a paper machine in which the dryer section in accordance with the present invention is applied.

Referring to the accompanying drawings wherein like reference numerals refer to the same or similar elements, each of the dryer groups in the inventive dryer section comprise drying cylinders 10, reversing rolls 11 and a drying wire 15 which is guided by guide rolls 18. In the dryer groups, if necessary, it is also possible to use blow boxes 16 in gaps between the reversing cylinders 11, by means of which blow boxes 16, spaces between the gaps are air-conditioned and evaporation of water from the web W is promoted. The faces of the drying cylinders 10 are kept clean by doctors 14 arranged to operate against the outer surface of the cylinders 10. The drying wires 15 press the web W to be dried on the drying cylinders against their smooth heated faces, and on the reversing cylinders 11 the web W remains at the side of the outside curve on the outer face of the wire 15, i.e., the wire is between the web and the outer surface of the reversing cylinders. On the reversing cylinders 11, the web W is kept reliably on support of the wire 15 against the effect of centrifugal forces by the effect of the negative pressure present in the grooved faces of the reversing cylinders 11. By means of this effect, shrinkage of the web W in the cross direction is also counteracted. As the reversing suction cylinders 11, preferably the suction cylinders marketed by the applicant under the trade mark "Vac-Roll"™ are used, which cylinders do not have inside or interior suction boxes, and with respect to the details of whose constructions reference is made to the assignee's U.S. Pat. No. 5,022,163, the specification of which is hereby incorporated by reference herein. However, it should be emphasized that the scope of the invention also includes dryer sections in which, in the positions of the reversing cylinders 11, conventional suction rolls provided with inside suction boxes and suction rolls of quite small diameters are employed.

In the dryer groups shown in the figures, preferably single-wire draw is employed, in which one drying wire only is used, on whose support the web W runs through the whole group so that the drying wire 15 presses the web on the drying cylinders 10 against the heated cylinder faces, and on the reversing cylinders 11 between the drying cylinders 10 the web W remains at the side of the outside curve. The drying cylinders 10 are placed outside the wire loop, and the reversing cylinders inside the loop. Most commonly, the drying cylinders are arranged in an upper row and the reversing cylinders 11 are arranged in a lower row, which rows are usually horizontal and parallel to one another. In the dryer groups illustrated in the accompanying figures, in particular in groups that are used for transferring the paper web between the stories, dryer groups are used in which the rows are inclined or vertical.

Figure 1B:
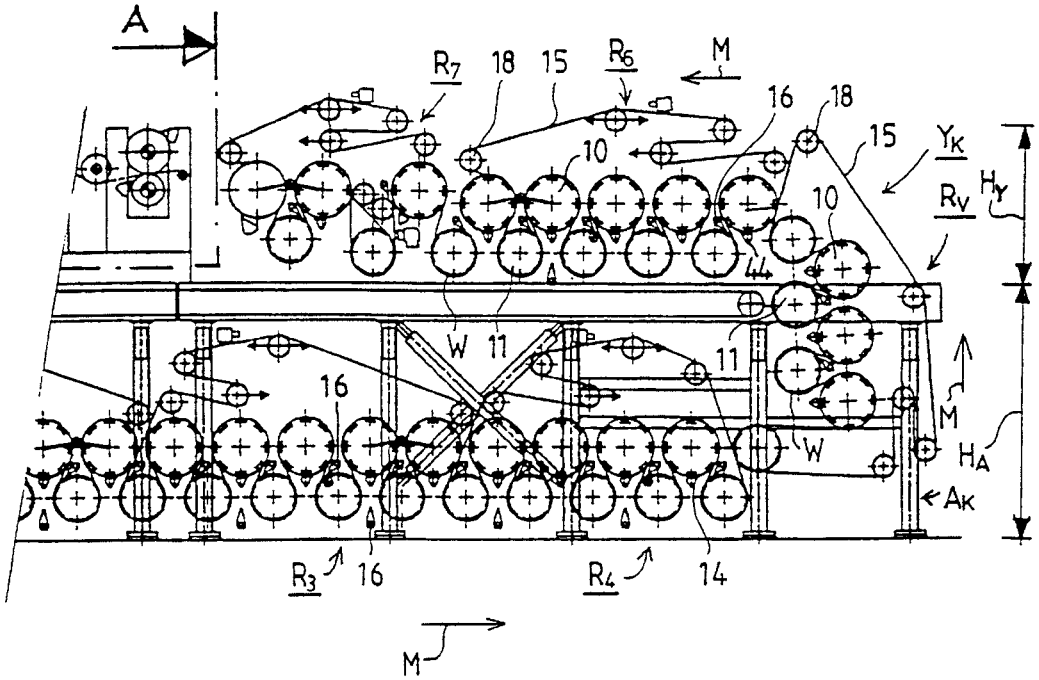

In the exemplifying embodiment as shown in FIGS. 1A and 1B, the paper web W is passed from a press section P, being guided by a downwardly inclined dryer group $R_z$ with normal single-wire draw, into the basement space, i.e., into a lower story Ak, where it is transferred onto a first dryer group $R_1$, which applies normal single-wire draw. In the basement, i.e., in the lower story $A_k$, the paper web is passed through the dryer groups $R_2, \ldots, R_4$ with normal single-wire draw onto a vertical dryer group $R_v$ which applies normal single-wire draw and by whose intermediate the paper web W is transferred to the dryer groups $R_6, \ldots, R_7$ placed on the machine hall level, i.e., in an upper story $Y_k$. After dryer group $R_7$, the web W is passed through a calender K to a reel-up S. When the paper web W to be dried is passed from the last group $R_4$ in the basement space, i.e., in the lower story $A_k$, to the vertical group $R_v$, the side of the web W that is placed against the drying cylinder is changed, i.e., inverted. When the web W is transferred from the basement $A_k$to the machine hall level $Y_k$, its substantial running direction M is also reversed.

Figure 2A:
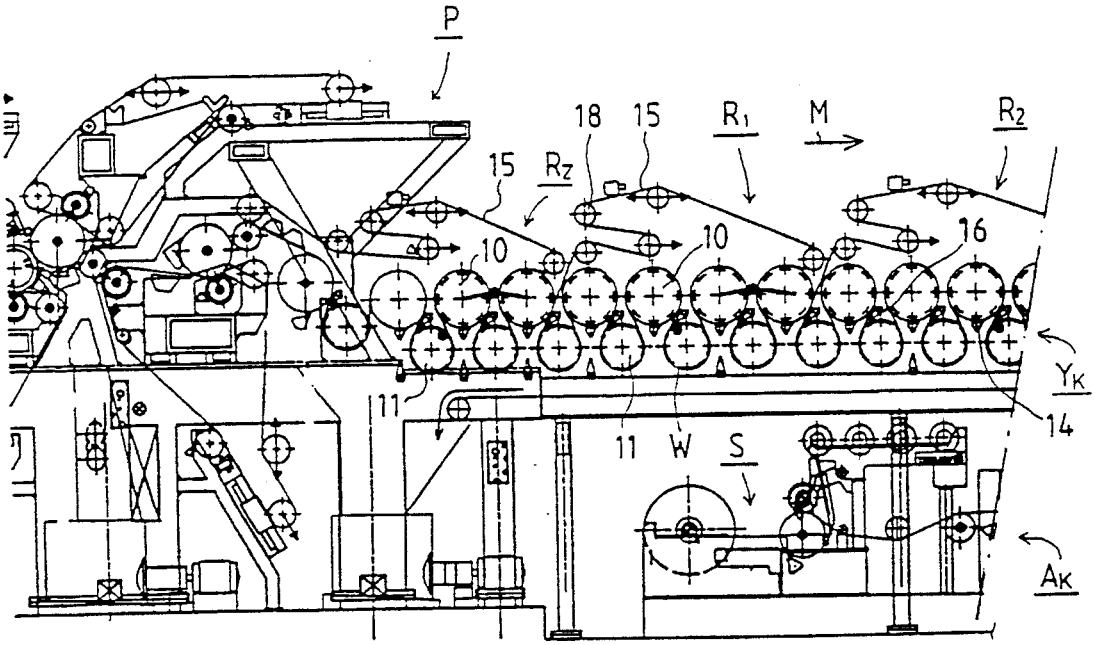
FIGS. 2A and 2B are each partial side views of a second exemplifying embodiment of a paper machine in which a second exemplifying embodiment of the dryer section in accordance with the present invention is applied.
Figure 2B:
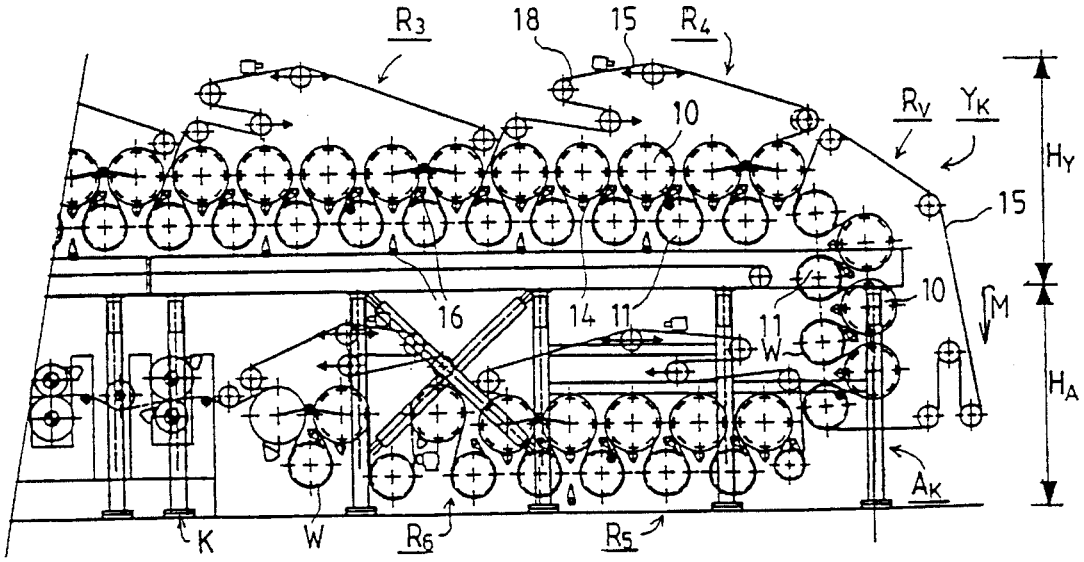

In the exemplifying embodiment shown in FIGS. 2A and 2B, the paper web W is passed from the press section, by the intermediate of the transfer dryer group $R_z$ with normal single-wire draw, on the machine hall level, i.e., in the upper story $Y_k$, to the first dryer group $R_1$ in the dryer section, which applies normal single-wire draw and from which the web is passed further to the dryer groups $R_2$,$R_3$ and $R_4$. After the dryer group $R_4$, the paper web W is passed into the basement space, i.e., into the lower story $A_k$, by means of a vertical dryer group $R_v$ with normal single-wire draw, and in the lower story $A_k$ there are two further dryer groups $R_5$ and $R_6$ with normal single-wire draw. After dryer group $R_6$, the paper web W is passed to the calender K and to the reel-up S. The face of the paper web W that is placed against the drying cylinder 10 is changed when the web is transferred from the vertical dryer group $R_v$ to the first group $R_5$ in the lower story $A_k$. When the web W is passed from the machine hall level $Y_k$ into the basement space $A_k$, its substantial running direction M is also reversed.

Figure 3:
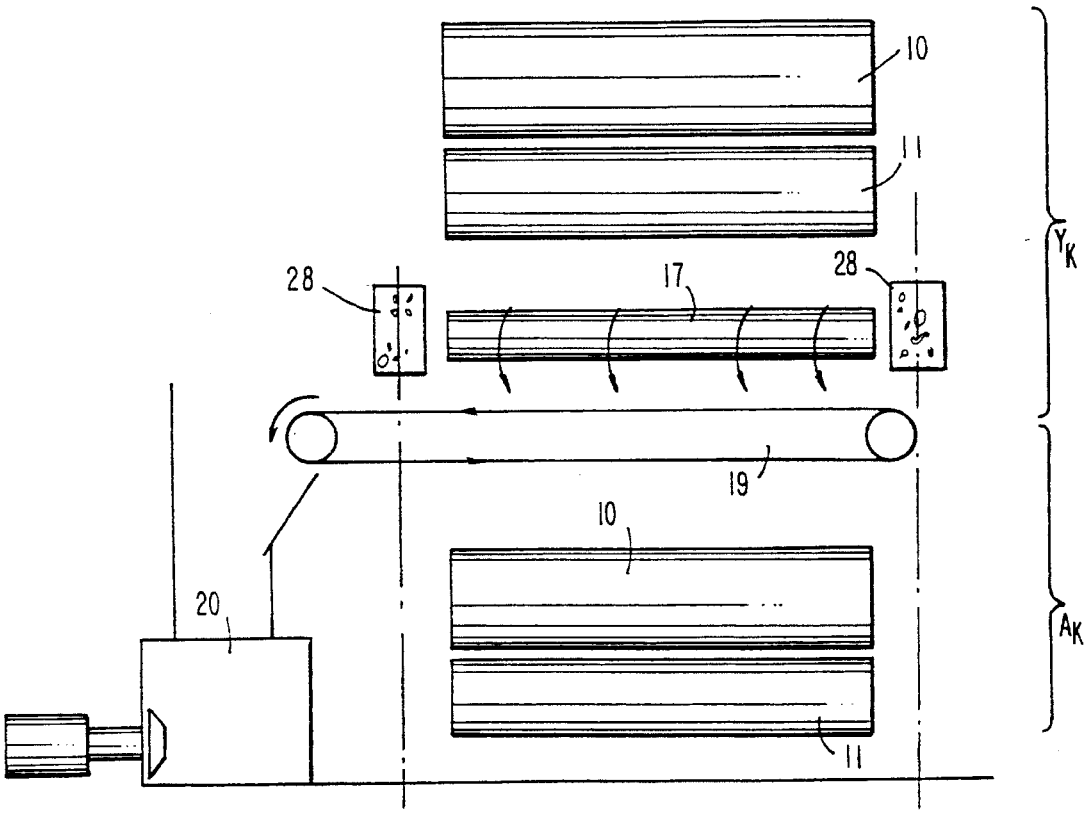
FIG. 3 is a sectional view taken along the line A—A in FIG. 1A.

FIG. 3 is a schematic sectional view taken along the line A—A in FIG. 1. The last drying cylinder 10 and the last reversing cylinder 11 in the group $R_6$ are placed in the upper story $Y_k$. A longitudinal conveyor 17 of the broke removing system is arranged in the upper story $Y_k$, which conveyor is placed between machine beams 28, and operates to transfer the broke from the cylinder 10 and from the reversing cylinder 11 to a transverse broke conveyor 19 which passes the broke into a pulper 20. The last drying cylinder 10 and the last reversing cylinder 11 of the group $R_1$ are placed in the lower story $A_k$.

In the arrangement as shown in FIG. 2, no transverse broke removing means are needed because the broke can be carried away in each group by means of the drying wire. By contrast, in the exemplifying embodiment shown in FIGS. 1A and 1B, a broke removing system, for example, similar to that shown in FIG. 3 is needed. In the exemplifying embodiments shown in FIGS. 1A and 1B and 2A and 2B, the substantial running direction M of the paper web W has been reversed and turned back towards the wet end (the initial end), in which case the reel-up S is placed directly alongside the press P, i.e., the dryer section that dries the paper web W forms a horizontal U-shaped loop, in which the branches of the "U" are directed towards the press section.

In the exemplifying embodiments illustrated in these figures, both the basement space and the machine level $A_k$, $Y_k$ are utilized as effective drying space so that substantially prior art horizontally proceeding drying runs are used. This does not, however, restrict the invention to such dryer groups only, but dryer groups of other types are also possible. The transfer groups $R_z$ and $R_v$ between the lower and the upper story $A_k$,$Y_k$ are slightly modified in respect of the transfer of the web W.

In the arrangement in accordance with the invention, both the lower story $A_k$ and the upper story $Y_k$ are air-conditioned, and the hood may, for example, comprise two stories so that the air-conditioning of upstairs and downstairs stories $A_k$, $Y_k$ can be controlled separately. The hood arrangement can be, for example, such that the traditional basement part, i.e., the lower story $A_k$, is not inside the hood, but the "bottom" is constructed directly underneath the cylinders.

In the exemplifying embodiment shown in FIGS. 1A and 1B, the dryer groups at the so-called wet end are passed through the basement, i.e., the lower story $A_k$, and the dry end (final end) and the reel-up S come back on the machine level, i.e., in the upper story $Y_k$, towards the press P. This provides the advantage that the monitoring of the wet end and of the dry end is concentrated in the same area, and the complete paper reels are placed in the upper story $Y_k$. In the finishing of paper, the construction lay-out can be solved in ways different from prior art constructions, whereby the transportation operations are optimized.

In the inverted arrangement shown in FIGS. 2A and 2B, the groups in the initial end, i.e., the dryer groups in the wet end, are placed on the machine level, i.e., in the upper story $Y_k$, as they are now. In this exemplifying embodiment, in order to increase the space for the return runs in the basement $A_k$, the groups in the upper story $Y_k$ may be raised to a higher level than in the prior art paper machine arrangements. The dry-end groups run in the basement, i.e., in the lower story $A_k$, toward the press P. In order to arrange the connections for the complete reels, new arrangements are needed for the building, in which, for example, the transportations are carried out either through the basement, i.e., the lower story $A_k$, to finishing or by lifting through an opening in the floor onto the machine level.

In the exemplifying embodiment shown in FIGS. 1A and 1B, the height $H_A$ of the space in the lower story $A_k$ is from about 7 m to about 12 m, preferably from about 8 m to about 9 m, and in the exemplifying embodiment shown in FIGS. 2A and 2B, the height $H_A$ of the space in the lower story $A_k$ is from about 8 m to about 15 m, preferably from about 9 m to about 10 m. The heights $H_y$ of the upper story $Y_k$ are from about 5 m to about 8 m, preferably from about 6 m to about 7 m, and from about 5 m to about 8 m, preferably from about 6 m to about 7 m, respectively.

Figure 4:
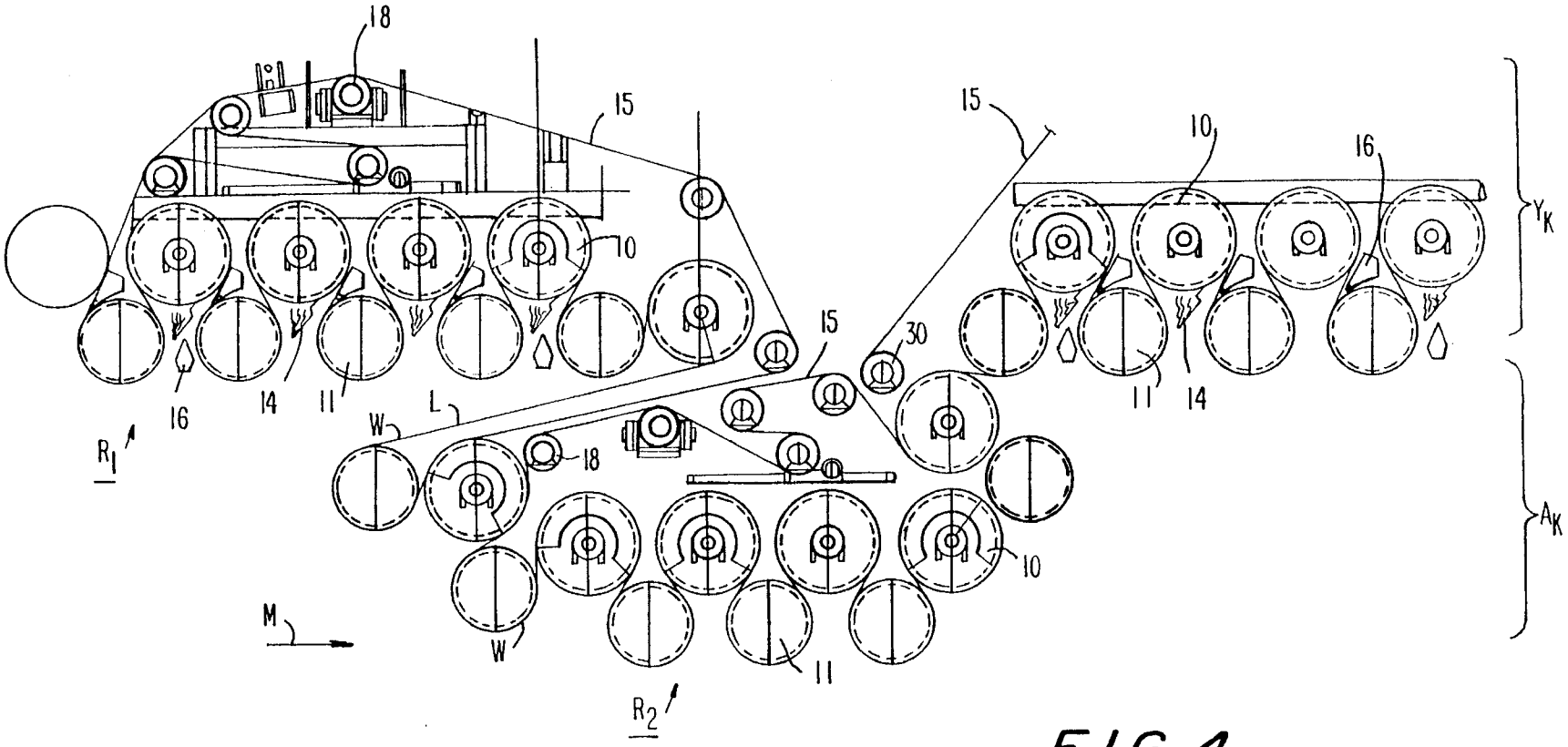
FIG. 4 is a view of an exemplifying embodiment for a dryer section arrangement in accordance with the invention.
Figure 5:
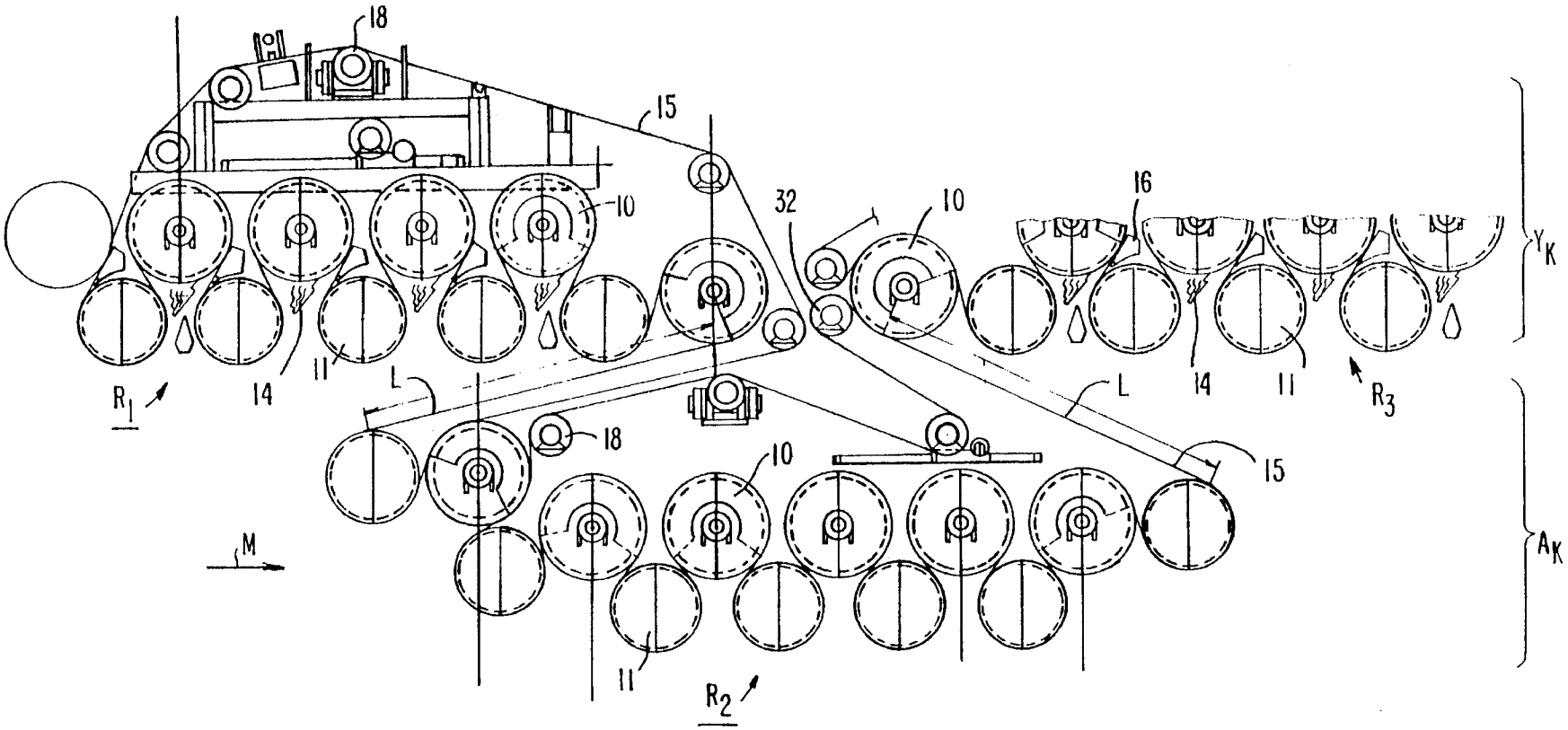
FIG. 5 is a view in part of a further exemplifying embodiment for a dryer section arrangement in accordance with the invention.

In the exemplifying embodiments shown in FIGS. 4 and 5, the dryer groups are arranged so that, for example, the first group $R_1$ is placed in the upper story $Y_k$ as an ordinary group with single-wire draw, and the second group $R_2$ is placed in the lower story $A_k$, and the web W is brought to the beginning of the second group $R_2$ over the distance L on the face of the wire 15 of the first group by means of an additional loop arranged in the circulation of the wire 15. The second group $R_2$ is a normal dryer group with single-wire draw with the exception that, thus, it is placed in the lower story $A_k$. The paper web W is brought to the beginning of the third group $R_3$ by a principle similar to that for the transfer to the beginning of the second group, i.e., an additional loop is arranged in the wire circulation 15 of the third dryer group $R_3$ by means of a guide roll 30. By means of the additional loop, the paper web W is transferred from the lower story $A_k$ to the upper story $Y_k$ as shown in FIG. 4. In the exemplifying embodiment shown in FIG. 5, the additional loop for passing the web W from the downstairs group $R_2$ to the upstairs group $R_3$ is arranged in the downstairs group $R_2$ by means of an additional loop of its wire 15, in which the wire 15 runs over a guide roll 32. Of course, in the lower story $A_k$, instead of one dryer group, it is possible to place several groups, which may be placed one after the other. The dryer groups can also be arranged so that the downstairs $A_k$ groups and the upstairs $Y_k$ groups alternate with one another.

By means of this arrangement, the whole dryer section can be placed, in the longitudinal direction, in a space of about half the length of a prior art dryer section and, as the web W runs on the upper face of the wire 15 over the straight draws L, its transfer between the stories $A_k$, $Y_K$ can be arranged quite readily. If necessary, in connection with the transfers between the stories, it is possible to provide runnability components (not shown) of a suitable holding effect, in which case the shrinkage of the web W can also be regulated by means of the extent of holding. At the same time, the draw L in the transfer to the lower story also operates as the broke conveyor below the first group $R_1$. During the draw L, evaporation also takes place from the paper W, the moisture content is equalized, the paper W and the wires 15 are cooled, whereby the subsequent drying cylinders 10 operate more efficiently. In the arrangement, the substantial or principal running direction M of the web W remains unchanged.

Figure 6:
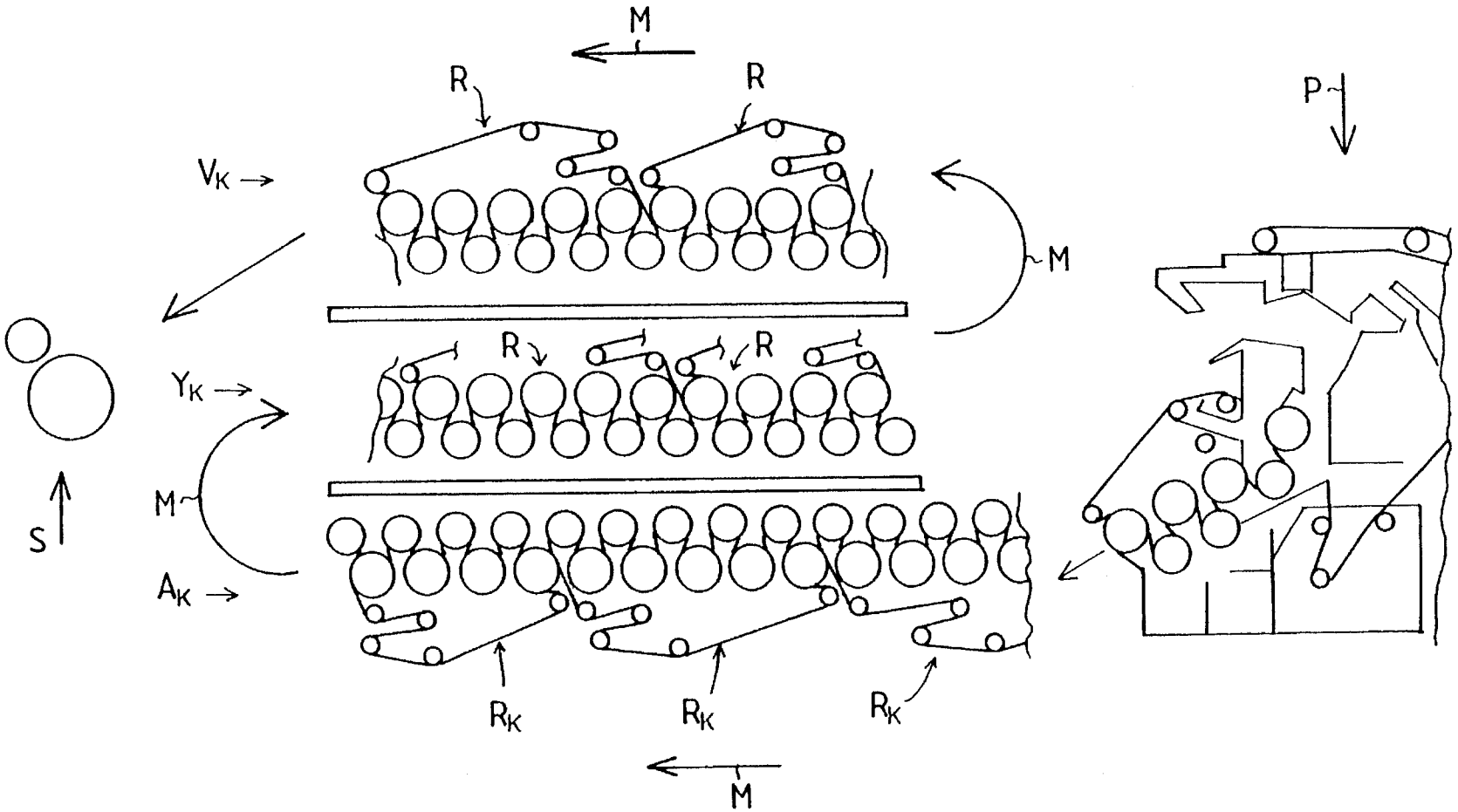
FIG. 6 is a view of a paper machine in which an exemplifying embodiment of the dryer section in accordance with the invention is applied.
Figure 7A:
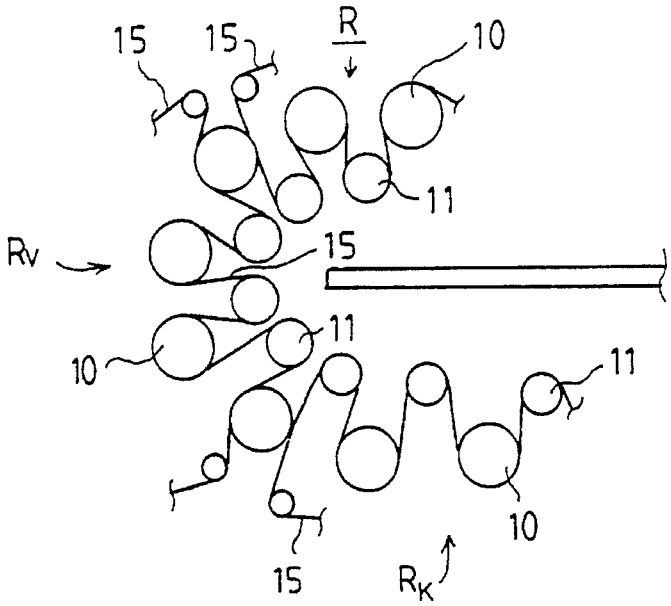
FIGS. 7A–7C show different alternative embodiments of the transfer of the paper web between the stories of dryer groups.
Figure 7B:
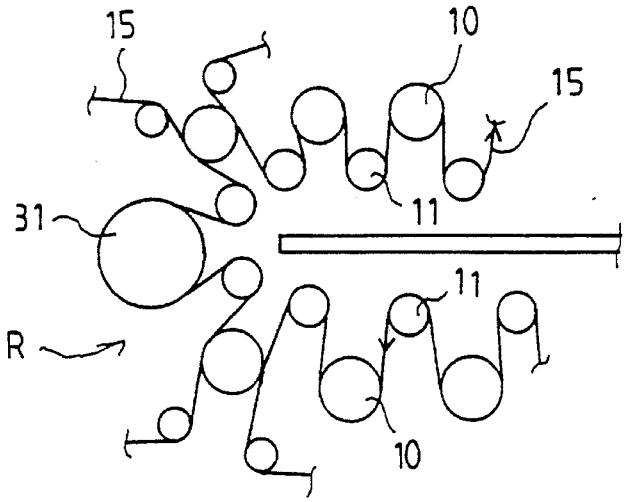
Figure 7C:
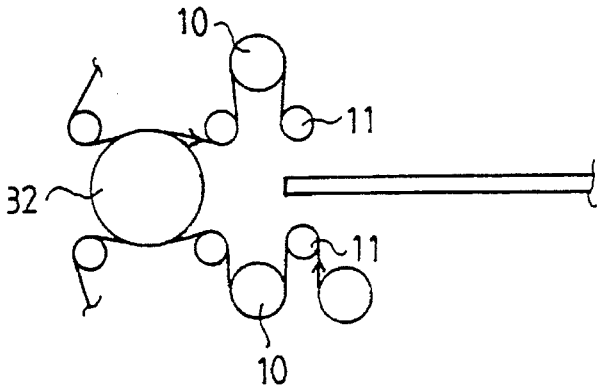
Figure 8:
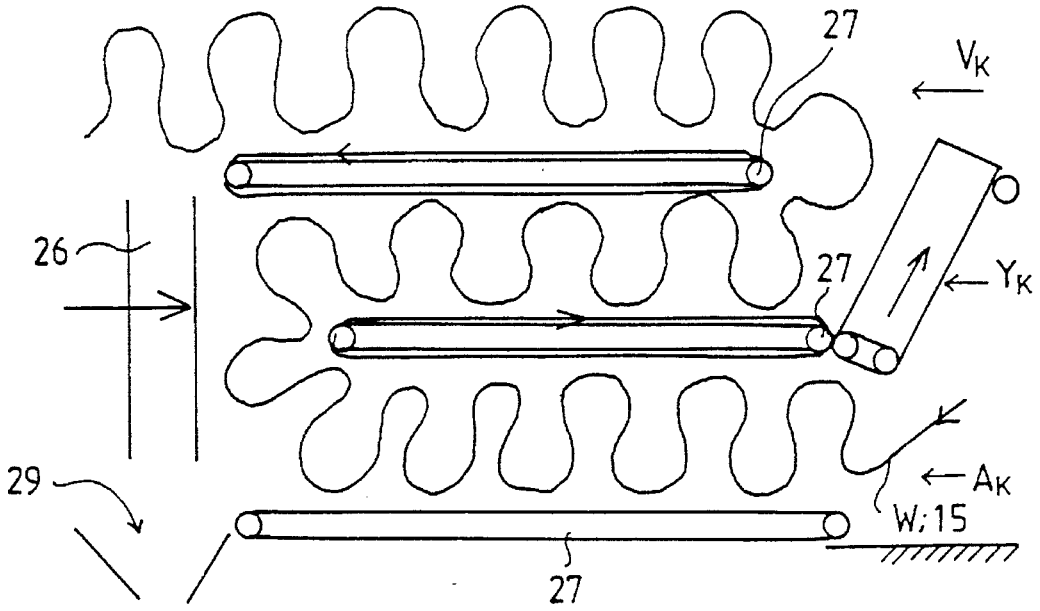
FIG. 8 shows an exemplifying embodiment of an arrangement of broke removal in an arrangement as shown in FIG. 6.
Figure 9:
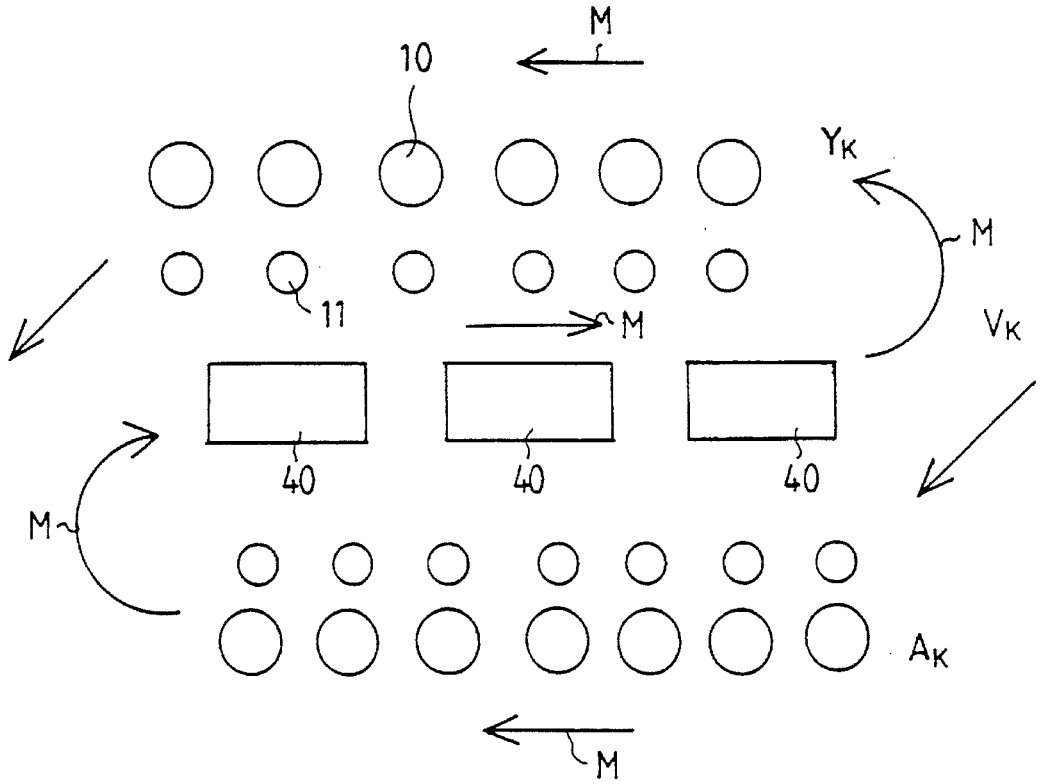
FIG. 9 is a view of an exemplifying embodiment of a dryer section in accordance with the invention.
Figure 10:
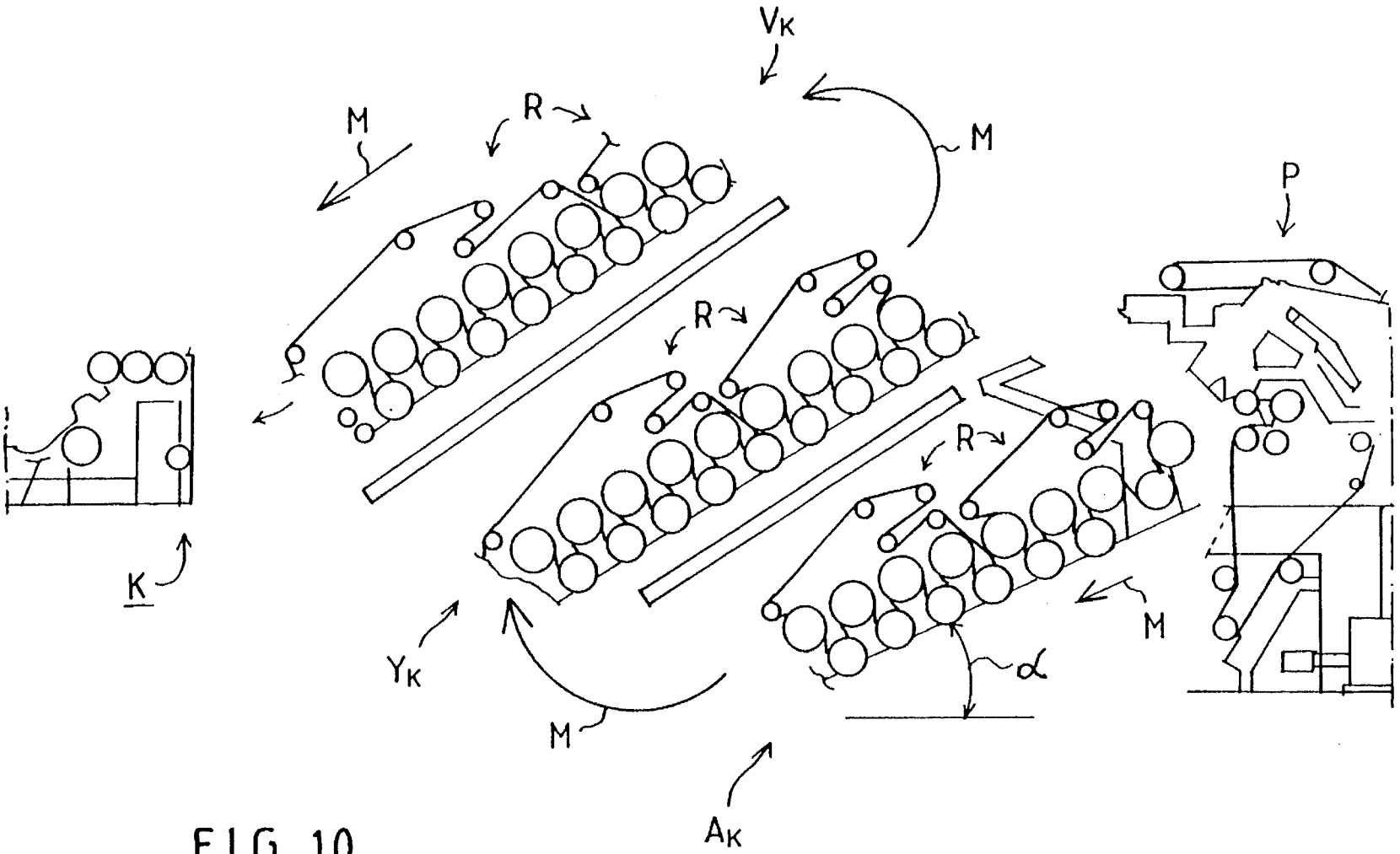
FIG. 10 is a view of a further exemplifying embodiment of a dryer section in accordance with the invention.

In the exemplifying embodiments illustrated in FIGS. 6–10, the dryer groups R in the dryer section are placed in three different stories $A_k$, $Y_k$, $V_k$, in which case the length of the dryer section can be reduced to about one third of what it would be in the prior art. In FIGS. 6, 9 and 10, the paper web W is passed from the press P into the lowest story $A_k$, from where it is passed to the machine hall level $Y_k$ into the intermediate story $Y_k$ and further into an additional story $V_k$. Broke conveyors 27 are placed between the stories $A_k$, $Y_k$, $V_k$, and with normal single-wire draw, it is hardly necessary to increase the height of the paper mill.

In the exemplifying embodiment shown in FIG. 6, in the dryer groups R placed in the intermediate story $Y_k$, which is placed on the machine hall level, and in the additional story $V_k$, on the drying cylinders 10 and reversing cylinders 11, normal single-wire draw is applied, and in the basement, i.e., in the lowest story $A_k$, inverted groups Rk are arranged. The grouping may, of course, also be different from that shown in FIG. 6. For example, normal single-wire draw can be used in the lowest story $A_k$. In FIG. 6, the web W is passed from the press P to the inverted groups Rk in the lowest story $A_k$, from which the web W is passed to the groups R with normal draw in the machine hall story $Y_k$ and further to the groups R in the third story $V_k$, from where the web W is passed to the reel-up S onto the machine hall level.

In the arrangement, between the stories, the substantial running direction M of the web is reversed, and two U-shaped loops are formed, whose branches point at opposite directions and which have a common middle branch.

FIGS. 7A–7C illustrate different exemplifying embodiments for passing the paper web W from one story to the other. As shown in FIG. 7A, between the stories, a dryer group $R_v$ can be used, in which the drying cylinders 10 are placed vertically so that, from the last cylinder 10 in the group $R_v$, the web W is passed onto the wire 15 of the group R placed on the same level. According to FIG. 7B, for the transfer of the web W between the stories, a dryer group R is used which consists of a so-called large drying cylinder 31, whose diameter is from about 1.5 m to about 3.5 m, preferably from about 1.8 m to about 2.8 m, of the wire 15, and of its guide rolls 18. Alternatively, the transfer between the stories can be accomplished by means of a large drying cylinder 32 placed between the stories (FIG. 7C), which cylinder has no wire circulation of its own and whose diameter is from about 1.5 m to about 5 m, preferably from about 2.5 m to about 4 m.

FIG. 8 illustrates an arrangement of broke removal in a three-story $A_k$, $Y_k$, $V_k$ dryer section, in which a belt-type longitudinal conveyor 27 is placed on the floor of each story and in which the paper web W is removed from the longitudinal conveyors 27 of the upper additional story $V_k$ and of the lowest story $A_k$ into the pulper 29 by means of a vertical conveyor 26 or chute. From the longitudinal broke conveyor of the intermediate story $Y_k$ on the machine hall level, the paper web W is transferred into the pulper 29 by means of a transverse conveyor 23. The arrows indicate the direction of travel of each longitudinal conveyor.

In the exemplifying embodiment shown in FIG. 9, the dryer groups in the middle story, i.e., the story $Y_k$ on the machine hall level, have been substituted for by dryers 40 that provide economies of space, for example, airborne, infrared, etc. dryers. In the lowest story $A_k$ there are inverted dryer groups $R_k$, and in the uppermost story $V_k$, there are normal dryer groups R. Both in the lowest story $A_k$ and in the uppermost story $V_k$, it is also possible to use normal dryer groups. In the arrangement between the stories, the substantial running direction M of the web is reversed, and two U-shaped loops are formed, whose branches point at opposite directions and which have a common middle branch.

In the exemplifying embodiment shown in FIG. 10, the stories are placed diagonally, and therein it is possible to apply the arrangements illustrated in FIGS. 7A–7C for the transfers between the stories, and so also the broke-removal arrangements described above. The dryer groups R in each story $A_k$, $Y_k$, $V_k$ are formed inclined so that the angle between the horizontal plane and the plane passing through the center axes of the cylinders is from about 0° to about 90°, preferably from about 20° to about 45°.

The examples provided above are not meant to be exclusive. Many other variations of the present invention would be obvious to those skilled in the art, and are contemplated to be within the scope of the appended claims.

We claim:

1. In a paper machine hall having at least two stories, a dryer section of a paper machine including a plurality of dryer groups, each of said dryer groups having drying cylinders, reversing cylinders arranged between each pair of the drying cylinders and a respective wire which presses a web against cylinder faces of the drying cylinders and carries the web over the reversing cylinders, the dryer section comprising at least one of said dryer groups being arranged in a first story of said at least two stories, the drying cylinders in said at least one dryer group in said first story being arranged in only a single substantially horizontal row such that the web is carried by the respective wire in said at least one dryer group in said first story in a single substantially uniform horizontal direction through said at least one dryer group in said first story, at least another one of said dryer groups being arranged in a second story of said at least two stories, the drying cylinders in said at least one dryer group in said second story being arranged in only a single substantially horizontal row such that the web is carried by the respective wire in said at least one dryer group in said second story in a single substantially uniform horizontal direction through said at least one dryer group in said second story, and transfer means for transferring the web from said at least one dryer group in said first story to said at least one dryer group in said second story.

2. The dryer section of claim 1, wherein said first story comprises a basement space defined in the dryer section below a level of the machine hall, said second story being the machine hall level.

3. The dryer section of claim 1, wherein said at least one dryer group in said first story and said at least another dryer group in said second story each comprise said drying cylinders arranged in a first row and said reversing cylinders arranged in a second row spaced from said first row, said wire constituting the only wire in said dryer groups such that said at least one dryer group in said first story and said at least another dryer group in said second story apply single-wire draw.

4. The dryer section of claim 1, wherein said first story is situated below said second story, said at least one dryer group in said first story being situated at a wet end of the dryer section, said at least another dryer group in said second story being situated at a dry end of the dryer section.

5. The dryer section of claim 1, wherein said transfer means comprise an intermediate dryer group arranged between said first story and said second story, said intermediate dryer group comprising drying cylinders, reversing cylinders arranged between each pair of the drying cylinders and a wire which presses a web against cylinder faces of the drying cylinders and carries the web over the reversing cylinders, whereby a plane running through center points of said drying cylinders in said intermediate dryer group is downwardly inclined.

6. The dryer section of claim 1, wherein said transfer means comprise an intermediate dryer group arranged between said first story and said second story, said intermediate dryer group comprising a substantially vertical row of drying cylinders, reversing cylinders arranged between each pair of the drying cylinders and a wire which presses a web against cylinder faces of the drying cylinders and carries the web over the reversing cylinders, whereby a plane running through center points of said drying cylinders in said intermediate dryer group is downwardly inclined.

7. The dryer section of claim 1, wherein said dryer groups are arranged only in said first and second stories.

8. The dryer section of claim 7, wherein said first story is situated below said second story, said second dryer group being situated at a wet end of the dryer section, said first dryer group being situated at a dry end of the dryer section.

9. The dryer section of claim 1, further comprising at least an additional one of said dryer groups arranged in a third story and means for transferring the web between said at least additional dryer group in said third story and at least one of said at least one dryer group in said first story and said at least another dryer group in said second story.

10. The dryer section of claim 1, further comprising drying means arranged in a third discrete story and means for transferring the web between said drying means and at least one of said at least one dryer group in said first story and said at least another dryer group in said second story, said drying means comprising at least one of an airborne, infrared and equivalent dryer.

11. The dryer section of claim 1, wherein at least one of said dryer groups comprises an inverted dryer group with single-wire draw in which said drying cylinders are arranged in a lower row and said reversing cylinders are arranged in an upper row above said lower row of drying cylinders.

12. The dryer section of claim 1, wherein said transfer means are arranged such that a first side of the web contacts cylinder faces of said drying cylinders in one of said dryer groups in said first or second story and a second, opposite side of the web contacts cylinder faces of said drying cylinders in one of said dryer groups in the other of said first and second story.

13. The dryer section of claim 1, wherein the main running direction of the web is reversed between said first story and said second story.

14. The dryer section of claim 1, wherein said dryer groups are arranged only in said first and second stories, the running direction of the web having a horizontal U-shaped run in said first and second stories, wherein said first story is located within a basement space defined in the dryer section below a level of the machine hall and said second story is positioned above said machine hall level.

15. The dryer section of claim 1, wherein said at least another one of said dryer groups in a second story comprise first and second dryer group arranged in said second story, said first story being situated below said second story, said at least one dryer group in said first story being arranged between said first and second dryer groups in said second story such that the web is passed from said first dryer group in said second story to said at least one dryer group in said first story to said second dryer group in said second story.

16. The dryer section of claim 1, further comprising a broke conveyor arranged below each of said at least one dryer group in said first story and said at least another dryer group in said second story.

17. The dryer section of claim 1, wherein said first story is situated below said second story, further comprising a broke conveyor arranged only below said at least another dryer group in said second story.

18. The dryer section of claim 1, wherein said drying cylinders in said dryer groups in said first and second stories are arranged in a first row and said reversing cylinders in said dryer groups in said first and second stories are arranged in a second row spaced from said first row.

19. The dryer section of claim 1, wherein said transfer means comprise a single large-diameter cylinder having a diameter from about 1.5 m to about 5 m, the web being carried by the wire in said at least one dryer group in said first story onto a surface of said large-diameter cylinder to be received thereon, the web being carried on said surface of said large-diameter cylinder into engagement with the wire in said at least another dryer group in said second story, such that the web does not contact a wire during its transfer from said first story to said second story.

20. The dryer section of claim 1, wherein said transfer means comprise a single large-diameter cylinder having a diameter from about 1.5 m to about 3.5 m and a wire passing over said large-diameter cylinder, the web being transferred from the wire in said at least one dryer group in said first story to the wire of said transfer means and carried thereon into engagement with a surface of said large-diameter cylinder and then being transferred onto the wire in said at least another dryer group in said second story.

21. In a paper machine hall having at least two stories, a dryer section of a paper machine including a plurality of dryer groups, each of said dryer groups having drying cylinders, reversing cylinders arranged between each pair of the drying cylinders and a wire which presses a web against cylinder faces of the drying cylinders and carries the web over the reversing cylinders, the dryer section comprising at least one of said dryer groups being arranged in a first story of said at least two stories, said first story being a basement space defined in the dryer section below a level of the machine hall, at least another one of said dryer groups being arranged in a second story of said at least two stories, said second story being the machine hall level, and means for transferring the web from said dryer group in said first story to said dryer group in said second story.

22. In a paper machine hall having at least two stories, a dryer section of a paper machine including a plurality of dryer groups, each of said dryer groups having drying cylinders, reversing cylinders arranged between each pair of the drying cylinders and a wire which presses a web against cylinder faces of the drying cylinders and carries the web over the reversing cylinders, the dryer section comprising at least one of said dryer groups being arranged in a first story of said at least two stories, at least another one of said dryer groups being arranged in a second story of said at least two stories, and transfer means for transferring the web from said dryer group in said first story to said dryer group in said second story, said transfer means comprising an intermediate dryer group arranged between said first story and said second story, said intermediate dryer group comprising drying cylinders, reversing cylinders arranged between each pair of the drying cylinders and a wire which presses a web against cylinder faces of the drying cylinders and carries the web over the reversing cylinders, whereby a plane running through center points of said drying cylinders in said intermediate dryer group is downwardly inclined.

* * * * *